US005916096A

United States Patent [19]

Wiesmann et al.

[11] Patent Number: 5,916,096

[45] Date of Patent: Jun. 29, 1999

[54] ADVANCED SURGICAL SUITE FOR TRAUMA CASUALTIES

[76] Inventors: William P. Wiesmann, 7001 Endicott Ct., Bethesda, Md. 20817; Charles L. Linden, Jr., 1239 N. Bayshore Dr., Valparaiso, Fla. 32580; Louis M. Guzzi, 590 Estates Pl., Longwood, Fla. 32779

[21] Appl. No.: 09/045,815

[22] Filed: Mar. 23, 1998

Related U.S. Application Data

[60] Provisional application No. 60/045,853, May 7, 1997.

[51] Int. Cl.[6] ..... E04H 3/08; E04B 1/344

[52] U.S. Cl. ..... 52/63; 52/64; 52/67; 52/69; 52/70; 52/79.5; 52/143; 135/87; 135/91; 135/96; 135/95; 135/139

[58] Field of Search ..... 52/63, 143, 64, 52/67, 68, 69, 70, 71, 79.5; 135/87, 91, 93, 97, 95, 96, 115, 139, 88.01, 88.13; 296/159, 163, 165, 171, 175; 312/209

[56] References Cited

U.S. PATENT DOCUMENTS

| | | | |
|---|---|---|---|
| 1,156,693 | 12/1915 | Koger | 52/69 |
| 2,492,198 | 12/1949 | Smith | 52/69 X |
| 2,692,161 | 10/1954 | Van Tassel | 52/67 X |
| 2,863,178 | 12/1958 | Hagan | 52/69 |
| 3,217,722 | 11/1965 | Heise | 52/63 |
| 3,840,267 | 10/1974 | Honigman | 52/64 X |
| 3,862,525 | 1/1975 | Greenspan | 52/64 |
| 4,016,951 | 4/1977 | Dick et al. | 52/143 X |
| 4,644,705 | 2/1987 | Saccomani et al. . | |
| 4,741,133 | 5/1988 | Kutzner | 52/79.5 |
| 5,171,056 | 12/1992 | Faludy et al. | 52/67 X |
| 5,185,973 | 2/1993 | Oldani . | |
| 5,224,305 | 7/1993 | Kassai | 52/67 X |
| 5,398,463 | 3/1995 | Wright | 52/64 X |
| 5,727,353 | 3/1998 | Getz et al. | 52/79.5 X |

*Primary Examiner*—Robert Canfield

*Attorney, Agent, or Firm*—Farkas & Manelli, pllc; Edward J. Stemberger

[57] ABSTRACT

A portable care facility includes at least one container defining a generally box-shaped configuration in a closed condition. The container is sized for transport and shipping and is constructed and arranged to be openable and expandable from the box-shaped configuration into a larger, operative configuration defining a space sufficient to conduct certain procedures therein. Tenting structure is provided in the container and is sized and configured to be supported over the space to define a ceiling over the space and to extend in at least one direction generally outwardly from the space to define a covered triage area.

19 Claims, 5 Drawing Sheets

ADVANCED SURGICAL SUITE FOR TRAUMA CASUALTIES

This application claims benefit to U.S. provisional application 60/045853 filed May 7, 1997.

BACKGROUND OF THE INVENTION

This invention relates to self-contained, rapidly deployable, small footprint facility capable of providing trauma management, resuscitative surgery, ancillary services, or temporary patient holding.

In certain environments such as battlefields, natural disasters areas and mass casualty disaster areas, there is a need to facilitate the treatment of trauma injuries and to provide aggressive life saving and casualty stabilization. For example, Forward Resuscitative Surgery (FRS) is an initial emergency surgical approach to a combat casualty with the goal of saving life and limb by implementing treatments which net sufficient clinical stability to allow the casualty to be moved to a definitive surgical facility far removed from the area of conflict. FRS focuses on producing a 4 to 8 hour "window" of clinical stability, which can be exploited by medical evacuation and en route care to reduce death on the battlefield. FRS seeks to exploit the most advanced surgical technologies and concepts to achieve this goal and provide these technologies farther forward than ever before. When properly designed, equipped, and employed, FRS should net a reduction in casualties, killed in action, that would otherwise die within one to two hours of wounding.

A need therefore exists to enable FRS by providing a self-contained, rapidly deployable facility for treating trauma injuries and providing life-saving and casualty stabilization as close to the site of injury as possible.

SUMMARY OF THE INVENTION

An object of the present invention is to fulfil the need referred to above. In accordance with the principles of the present invention, this objective is obtained by providing a portable medical care facility including at least one container defining a generally box-shaped configuration in a closed condition. The container is sized for transport and shipping and is constructed and arranged to be openable and expandable from the box-shaped configuration into a larger, operative configuration defining a space sufficient to conduct certain procedures therein. Tenting structure is provided in the container and is sized and configured to be supported over the space to define a ceiling over the space and to extend in at least one direction generally outwardly from the space to define a covered triage area.

These and other objects of the present invention will become apparent during the course of the following detained description and appended claims.

The invention may best be understood with reference to the accompanying drawings wherein illustrative embodiments are shown.

BRIEF DESCRIPTIONS OF THE DRAWINGS

DETAILED DESCRIPTION OF THE PRESENTLY PREFERRED EXEMPLARY EMBODIMENTS

Figure 1:
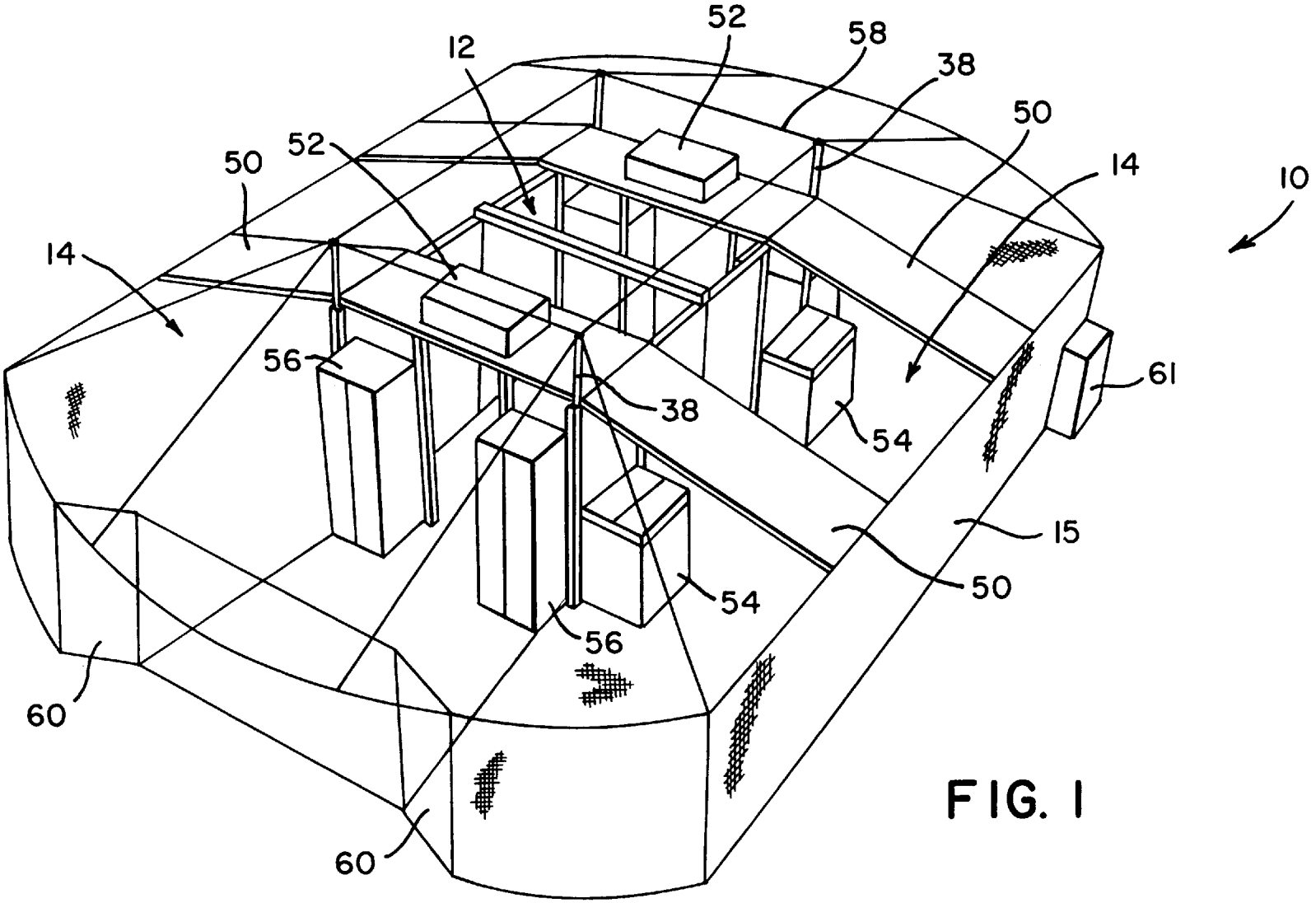
FIG. 1 is a perspective view of an Advanced Surgical Suite for Trauma Casualties (ASSTC) provided in accordance with the principles of the present invention, shown in an operative condition and with tenting structure thereof in transparent form so that the internal structure may be seen.

Referring to the drawings, an Advanced Surgical Suite for Trauma Casualties (ASSTC) is shown in FIG. 1, generally indicated at 10, which embodies the principles of the present invention. The ASSTC 10 in FIG. 1 is shown in a deployed condition and includes an internal space defining a medical procedure area or operating unit 12, and triage areas 14 extending outwardly from the operating unit 12, defined by tenting structure 15. The tenting structure 15 also provides a ceiling over the triage areas 14 and operating unit 12. The tenting structure is shown to be transparent in FIG. 1, for illustrative purposes only, so that the interior of the ASSTC can be seen.

Figure 2:
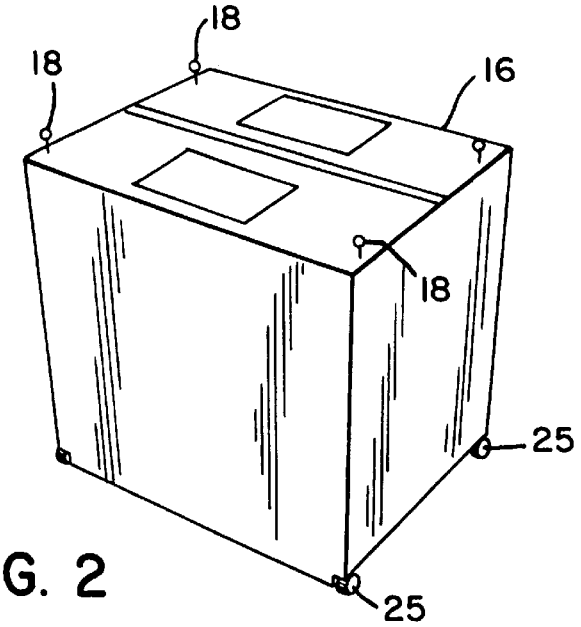
FIG. 2 is a perspective view of the ASSTC of FIG. 1, shown in a boxed-shaped, closed condition for transport.

In the illustrated embodiment (FIG. 2), the ASSTC 10 is packaged in a small container or unit 16, preferably of box-shape having dimensions generally 8'6"×6'8"×8'6" for transport and shipping. The container in a C-130 aircraft envelope and includes eye bolts 18 at each corner for handling as an unslung container from a helicopter or for use with various parachute and parafoil delivery systems.

In a full hospital configuration, an ASSTC system will fill a cargo hold of a single C-130 aircraft. A full ASSTC hospital consists of five and one half containers. Each of the five containers has a 8'6"×6'8" footprint and a weight of up to 4000 lbs. A full ASSTC hospital includes two operating suites (each formed from a separate container 16), two post-op suites (each formed from a separate container 16), one support and supply container and one-half pallet or container that contains a generator, fuel and possibly a small tractor. Modularity of the ASSTC allows for flexible configuration including possible rapid deployment of a single operating unit. Such deployment can be achieved with two Blackhawk helicopters or the like carrying one full container, a power generator and a skeleton crew of five. This deployment mode could be applicable in ship-to shore operations.

Figure 3:
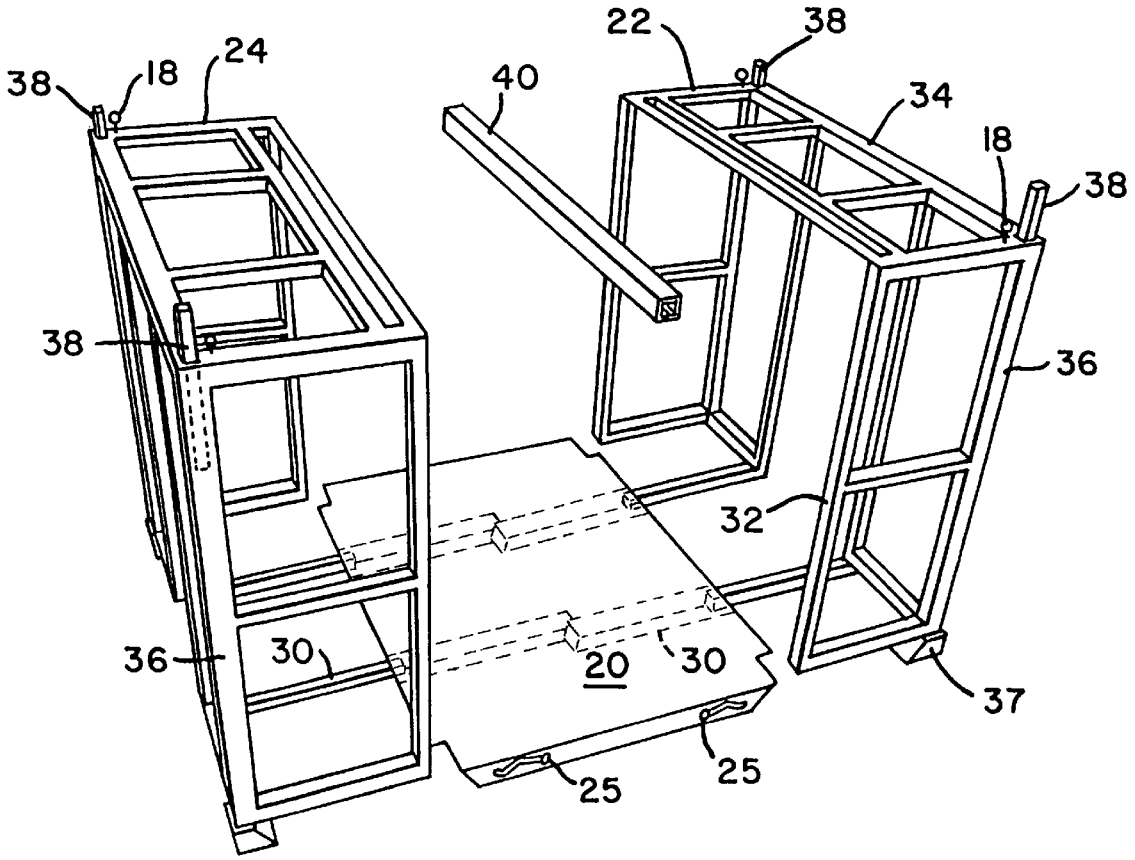
FIG. 3 is a perspective view of a chassis, cage units and overhead beam of the ASSTC of FIG. 1, shown with the panels thereof removed.
Figure 4:
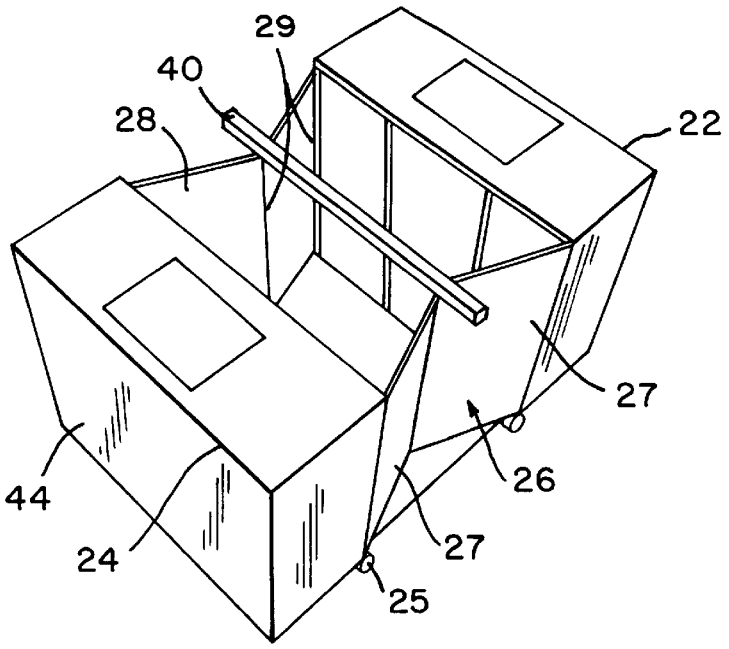
FIG. 4 is a perspective view of the ASSTC of the invention shown being initially expanded.

As best shown in FIGS. 3 and 4, the ASSTC includes three main subsystems: a chassis 20, two frames defining cage structure or units 22 and 24, and vertical hinging side panel assemblies 26 which are coupled via hinges to the cage structures 22 and 24 (FIG. 4). Each side panel assembly 26 and 28 comprises a pair of panels 27 that have hinges 29 on each vertical edge thereof. The chassis 20 consists of a five inch structural layer and a three inch foam filled, polyurethane covered, sacrificial skid layer. The structural parts of the chassis 20 are built on beams 21 arranged parallel to the direction of expansion of the container 16. Top and bottom structural skins are bonded to these beams and are interlocked in the spans by lightweight spacers and flat shock resistant structures (not shown). The chassis 20 includes telescoping beams 30 that attach to the cage units 22 and 24 to permit lateral movement thereof with respect to the chassis 20. The expansion telescoping beams 30 are supported for movement with respect to the chassis 20 by multiple rollers (not shown), and are located off-center, but centrally symmetric in relation to the chassis 20 (FIG. 3). In addition, the chassis 20 accommodates a towbar, and may accommodate vibration and shock resistant structure, small retractable wheels 25, and small compressors for operating medical devices. The cage units 22 and 24 are preferably of high strength aluminum and are constructed of large cross-section extrusions that allow for stiffness and provide support for movable supply containers (as will be described below) and for supporting ducting of the infrastructure. Each cage unit 22 and 24 includes side structure 32 and end structure 34. Corners of the cage units contain the eye bolts 18 for airsling deployment of the container 16. Vertical corner extrusions 36 house retractable masts 38 which are used to support the tenting structure 15. Further, the opposite ends of the corner extrusions 36 include retractable jacks 37 which may be employed to stabilize and level the operating unit.

Figure 4A:
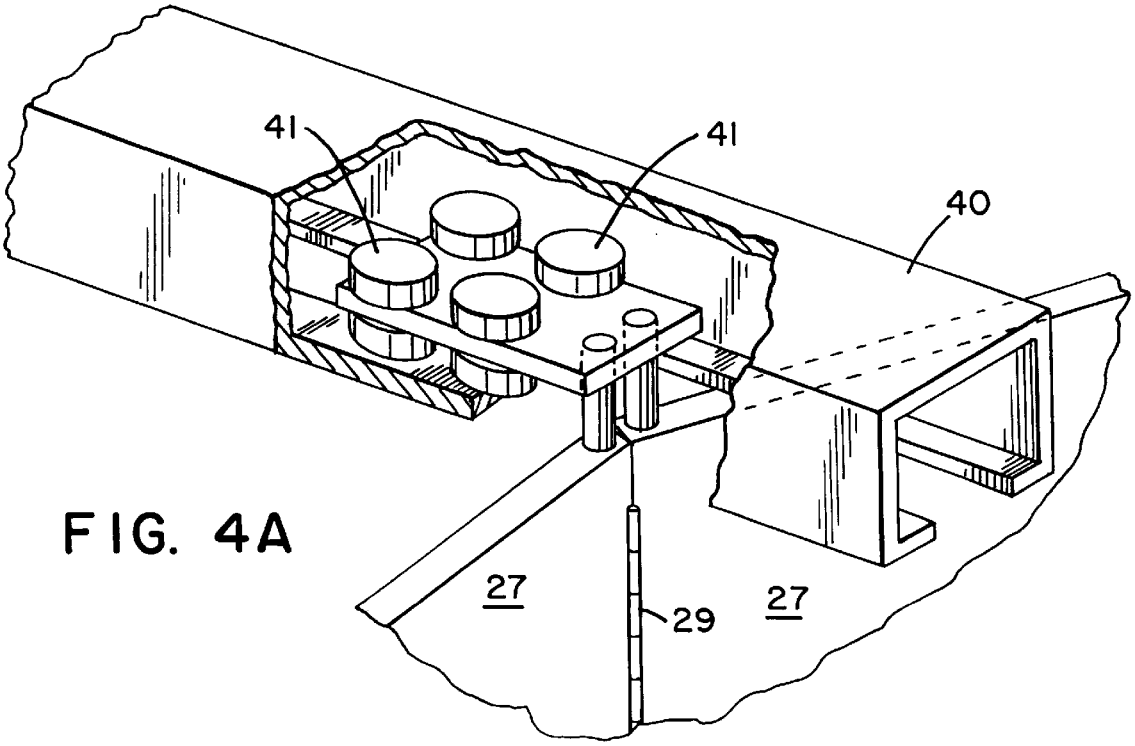
FIG. 4A is a perspective view of a connection between vertical hinged panels and an overhead beam.
Figure 5:
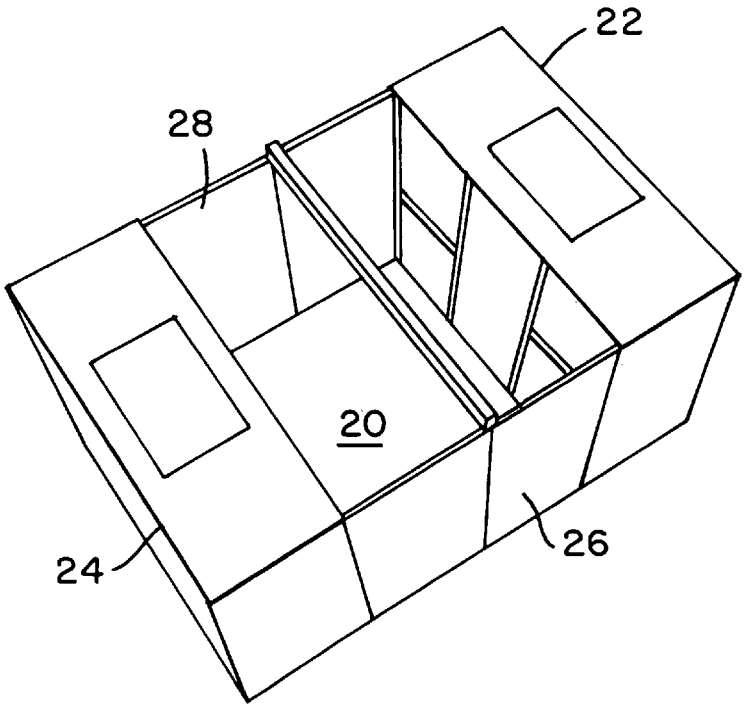
FIG. 5 is a perspective view of the ASSTC of FIG. 4 shown fully expanded.
Figure 6:
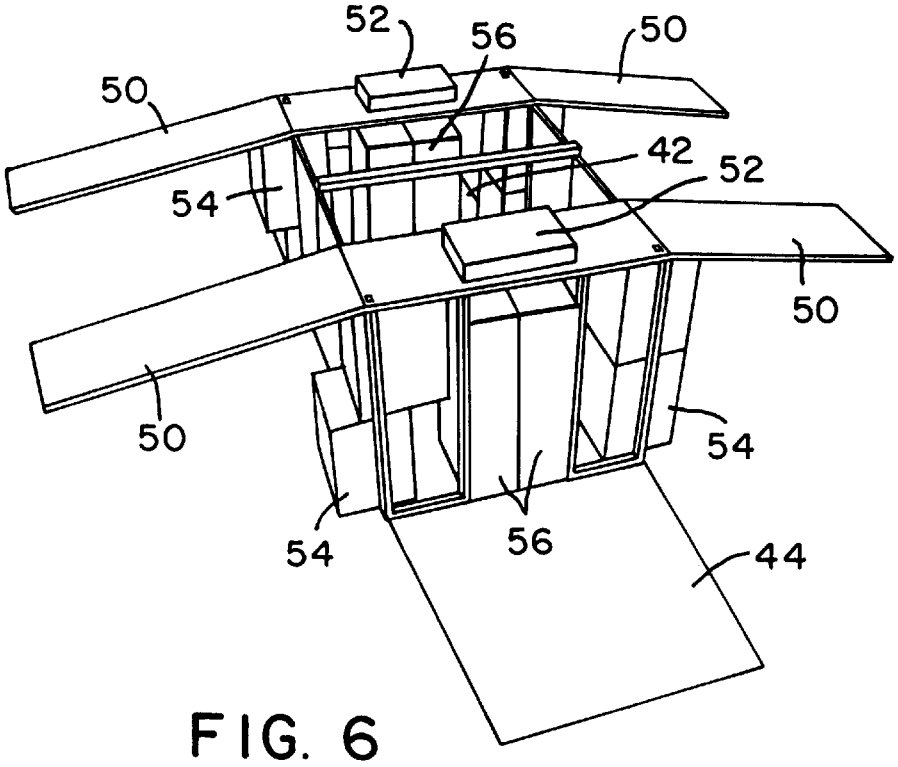
FIG. 6 is a perspective view of the ASSTC of FIG. 5 shown with support panels and end walls in operative positions.
Figure 7:
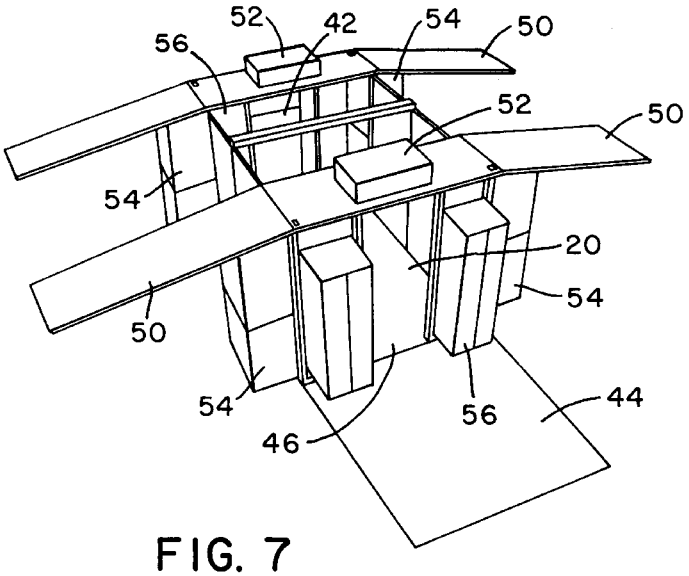
FIG. 7 is a perspective view of the ASSTC of FIG. 6 shown with supply containers and air handling units moved to operative positions thereof.

With reference to FIGS. 2–7, deployment of an individual container 16 will be appreciated. First, after a container 16 has been delivered to the site of injury via aircraft or other modes of transporting, the boxed-shape container is adjusted to the desired location by moving the container using the tow bar and skid bottom thereof. Next, the container 16 is elevated and leveled on the adjustable wheels 25. The container cage units 22 and 24 are then moved from a collapsed position wherein the cage units 22 and 24 are generally adjacent (FIG. 2), to an expanded, operative position wherein the cage units are in spaced relation (FIG. 5). The movement of the cage assemblies is facilitated by both the telescoping beams 30 in the chassis 20 and the hinged panel assemblies 26 and 28 on the sides of the container 16. Tops of each panel assemblies 26 and 28 are coupled to an overhead beam 40 via a floating beam on rollers 41 (FIG. 4A), such that as the cage units are extended, the panels 26 and 28 move outwardly along the beam 40 and about their hinges from a collapsed position wherein panels 29 of each panel assembly 26 and 28 are in generally overlapping relation, into an extended position, disposed in spaced relation (FIG. 5). End panels 42 and 44 are then unfolded downwardly, secured and leveled to define entry and exit floor platforms. As best shown in FIG. 7, floor panels 46 stored in the container 16 may be manually placed to define flooring. The floor panels 46 lock the end panels 44 and 42, respectively, into position. Four small side panels 50 defining ceiling support panels are raised and the supporting masts 38 are vertically extended from the corner extrusions 36. Air handling units 52 are then lifted into position. Cage unit mounted supply containers 54 are pushed into their operative position. Four supply cabinets 56 on casters are put into their position. The expanded operating unit 12 has a length dimension of approximately seven feet and a width dimension of approximately eight feet, four inches.

Next, as best shown in FIG. 1, the tenting structure 15 which was stored in the container 16 is deployed to define the triage areas 14, and the ceiling over the operating unit 12 and triage areas by use of the masts 38, bows and struts 58. Entry/exit soft air locks 60 and 62 are deployed. Next, an operating table is deployed, and finally, power hook-ups are completed and the unit is prepped for the first procedure. The unit is powered by a portable generator 62 that may be shipped within container 16 or may be shipped in a separate carton. It is noted that the first procedure can be initiated while the external tenting and triage area are still under deployment. The arched membrane ceiling can support one layer of sandbags if desired.

With reference to FIGS. 3, 6 and 7, each cage unit 22 and 24 provides support for the movable supply containers 56 that cantilever inwardly in a collapsed, shipping position and outwardly in a deployed position. The air handling units 52 are supported by the cage units and also facilitates their upward deployment. The open structure of the operating unit 12 is made rigid by the fixed supply containers 54. The floor, side wall and end wall panels are lightweight, preferably 0.75" to 1" thick composite sandwich or honeycomb metal.

The expansion of the cage units 22 and 24 is accomplished by rechargeable power tools or manual cranks in order to eliminate fixed and heavy dedicated drive motors. Deployment of the ASSTC requires approximately 42" of extension out or 80" wide chassis which provides ample overlap for effective cantilevering.

The tenting structure 15 is designed to provide lightweight and compact protection that is contained within the container 16 and that is easily deployed and available at all times. Climatic adaptation and ballistic protection is available in separate kits carried in a supply unit or in additional specialized units for extreme conditions. The tenting material is constructed of heavy-duty, rip stop nylon and utilizes technology developed for racing sails. The combination of tension, suspension and stressed, sail-like tent ceilings allows for head room, lower profile open floor space and better climatic control. In addition, the perimeter of the tenting structure 15 advantageously provides for flexible tie-down systems.

As noted above and as shown in FIG. 1, the ceiling support panels 50 are incorporated into the tent support structure. This allows for roof access for the purpose of maintaining the air handling units 52 and sandbagging. The controlled curvature of the tenting segments defines the overall shape and minimizes lift. The tent roof segmentation and stiff elements allow for flexible planning of partitions, better isolation of various contamination zones, and air handling control.

In the illustrated embodiment, the ASSTC includes two types of supply containers. Once type of container 54 is wall-mounted in the cage units 22 and 24, and preferably non-removable. The other type of container 56 is positioned on collapsible casters, riding on the floor and plugs into the end walls on each side of the entry/exit airlocks 60 and 62. The supply containers 56 are stepped-in at the corners and act as rails themselves. As the supply containers 56 are slid into position, they are locked into place at each end of their travel. The movable supply containers 56 have double doors that are hinged vertically, and after opening ninety degrees, recede into doubled walls on the sides. All supply containers can be accessed from both the inside and outside, but only one side at a time. This allows for resupply without interference with procedures and provides support for patients under external tenting or triage areas.

Figure 8:
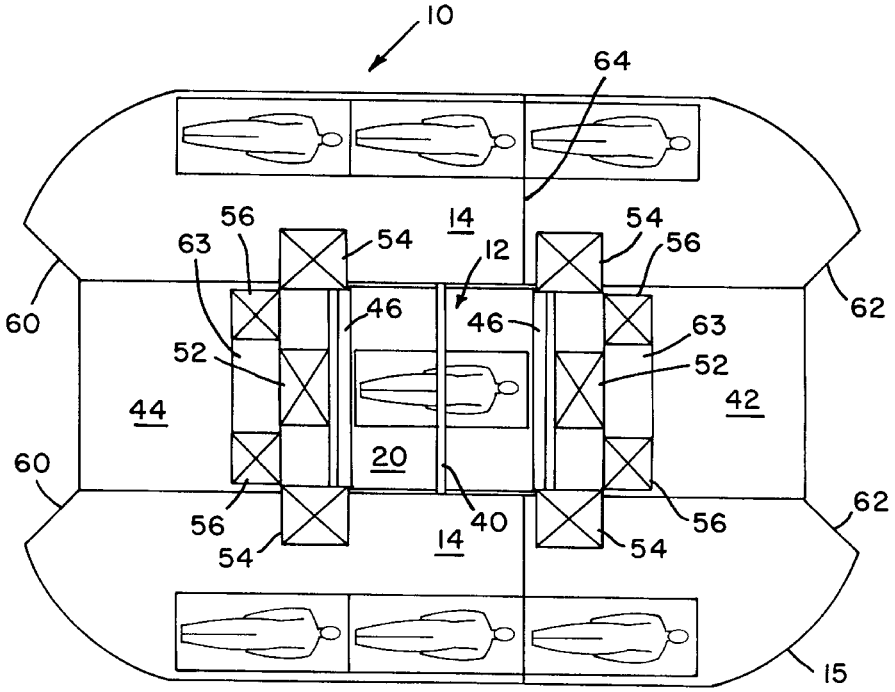
FIG. 8 is an schematic plan view of the ASSTC of FIG. 1.

The tenting structure 15 has two entrances 60 and two exits 62. As shown in FIG. 8, each entrance 60 leads to the triage area 14 that surrounds the core operating unit 12. The triage area 14 can accommodate six patents in a single tier. Casualties are evacuated and prepared for procedures in the triage area. The tilt-down end panels 44 at each end of the operating unit 12 provide an elevated platform at the same height as the floor of the operating unit. The patent's path is a straight line from the entry platform, through the soft air lock 63, through the operating room and onto the exit platform. From there, the patients are taken to a tandem unit that serves as a post-operative room. A post-op unit (not shown), configured from another container 16, is structurally identical to the operating unit but accommodates patients in a bunk bed configuration. For special operations, the triage and post-op functions may be accommodated in the same tented area. In this configuration, the tented triage area is separated from the post-op area by a dividing membrane 64. Otherwise, membrane 64 need not be provided. The triage area can contain four patients or eight if a bunk bed configuration is employed. Post-op function is accommodated in two positions, one on each side of the exit platform.

Patients are brought into the operating unit 12 either on a Life Support for Trauma and Transport LSTAT that serves as an operating platform or on a stretcher and transferred to the operating surface. Each of the four corners of the unit provides supply containers 54 and 56 that hold either medical equipment or supplies. Equipment and supplies are grouped to support anesthesia, imaging, surgery and consumables.

The preferred equipment provided in the containers includes an anesthesia machine, medical monitor instrumentation, an oxygen generator, a blood refrigerator, blood warmer and X-RAY/Imaging equipment a computer and communications equipment, suction, fluid warmer and an infusion pump, two head lamps, waste, waste compaction and a sharps container, primary autoclave, and a secondary autoclave.

Supplies include a thoracic box containing, for example, four thoracic sets, four neuro-surgical sets and thirty suture boxes, abnormal packing supplies, lap sponges and gauze, syringes and needles, I.V. fluids consisting of fifty bags of Ringers, fifty bags of normal I.V. solution, two hundred cans of Albumen and two hundred units of Dextran, airway supplies including Laryngeal Mask Airway LMA, Ambu bag, anesthetic pharmaceutical agents including muscle blockers, inhalational agents, atropine, pressers and dopamine, four general surgical orthopedic sets and four abdominal surgical sets, a second thoracic box, linens and consumables.

It can be appreciated that the above listed equipment and supplies are illustrative only. Other equipment and supplies may be provided based on particular needs and the function of the ASSTC.

For military use, ballistic protection against small arms fire is achieved through a combination of the hard sidewalls, supply containers and extrusion cages surrounding the inside of each core or operating unit 12. Additional protection from small arms horizontal fire can be provided for the tented triage area by attaching an additional six foot tall ballistic fabric "fence" (not shown) to the perimeter of the vertical tent walls. A basic, lower weight fabric can be put into place for civilian triage use.

The ASSTC utilizes exterior ports to supply both power and water. Power and water lines run through the extrusions that make up the cage units 22 and 24. Oxygen lines from oxygen concentrators can be developed as part of the infrastructure. A power harness is run from an exterior port located on the chassis 20 to multiple points inside each unit. Power hook-ups dedicated to surgical tools are located above the operating room table in an overhead lighting fixture coupled to the overhead beam 40. Infrastructure outlets for power, water and oxygen are also located externally to serve the triage area. Water stored in interior reservoirs located in the chassis 20 is accessed from both the interior and exterior of the unit. Resupply of water tanks is achieved through exterior chassis ports that can be refilled without interruption of operation procedures.

Strong and shadowless ambient lighting is provided by redundant metal halide HID fixtures with color rendition index (CRI) of 81 or better. Photocell controlled halogen back-up lighting is provided for short term power interruptions and restarts. The soft curved ceiling over the operating table is designed to work like a barrel reflector in a fashion similar to umbrella reflectors and shadow boxes used in studio photography.

The tent material is preferably foam encased in nylon fabric, which addresses heat loss and energy consumption issues. Mylar facing may be added to the interior surfaces to enhance cleanability, resist radiative heat loss, and provide for an opaque material. The tent frame is designed for nesting within the operating unit during shipping and is composed preferably of a carbon fiber composite material to adequately support the foam tent material.

The tent floor areas are preferably covered with durable, single layer vinyl or polyethylene material, which will integrate and seal with the operating unit and outer periphery of the tent walls. This will provide protection from the elements and assist maintenance of positive pressure in the triage and recovery areas. There is preferably a utility access corridor in the floor for potable water, waste water, power and other utilities for the operating unit.

Each air handling unit 52 is an HVAC power system, a standard unit of military supply, providing heating and cooling for the ASSTC and is combined with a Nuclear Biological Chemical NBC pressurized protection system. This will preferably provide the operating unit 12 with the highest pressure and slightly lower pressure in the triage and recovery areas 14.

The containerized modular approach to the whole system allows for partial deployment and more flexible applications, which in turn can accommodate a variety of military and civilian operations. For example, as noted above, if a full hospital is required, a plurality of containers (five and one-half containers) may be delivered to the site of injury. This would provide two operating units, two intensive post-op units, and a capacity of twenty-four persons for triage.

Another embodiment of the system may include three and one-half containers to configure a full hospital. In this embodiment, there is provided two 13'4"×8'6" Op/Post Op containers, one 8'6"×6'8" supply and communications container, and one-half pallet that contains a generator, fuel and possibly a small tractor. This embodiment is also designed around the cargo capabilities of a C-130 aircraft. The Op/Post-Op containers are expandable in a manner similar to that discussed above. This embodiment of the ASSTC provides larger and integrated operating and post-op spaces, more unitized and comfortable operating environments, but at the expense of not being capable of transport by light helicopters.

The ASSTC system fits into a potential doctrine that brings more aggressive surgical life saving procedures closer to the site of injuries and eliminates some of the echelons of care. In order to accomplish this, the system should be compatible with:

- enhanced high-tech medic capabilities in the first echelon of care
- advanced life support and monitoring equipment (mini-STAT or LSTAT)
- adoption of enhanced communication and tele-medicine technologies
- accelerated evacuation of stabilized patients from both the site of injury and the ASSTC units It can be appreciated that the invention, the ASSTC, meets many of the essential issues for delivery of FRS. The ASSTC provides a self-contained, rapidly deployable, small footprint facility capable of providing trauma management, resuscitative surgery, ancillary services, or temporary, though austere, patient holding. The ASSTC is configured for a forward area combat situation and will provide limited surgical hemostasis, bowel closure, airway repair and splinting necessary to support life and limb during continued evacuation to definitive care.

The adaptability requirement for on-board ship resupply means the ASSTC facility can be readily reconfigured for situations other than combat. As such, the facility can become a postoperative suite, dental unit or decontamination unit. In cases where the LSTAT is not available, such as under disaster relief or humanitarian missions, the services supplied by the LSTAT (defibrillator, ventilation, suction, blood analysis, etc.) can be supplied by auxiliary equipment packaged in the ASSTC cabinets.

An ASSTC may be set-up by 1–2 people in approximately 15–30 minutes and contains sufficient durable and expendable supplies to support 20 salvage surgeries in 48 hours. This means significantly faster delivery of life-saving operating room table hours to forward troops.

Thus, ASSTC provides a complete medical care facility from a single container. It can be appreciated that the system can serve as a protective shelter or treatment unit in both chemically and biologically contaminated environments upon modification, such as, for example, by adding air locks, etc.

While the invention has been described in connection with what is presently considered to be the most practical and preferred embodiments, it is understood that the invention is not limited to the disclosed embodiments, but, on the contrary, is intended to cover various modifications and equivalent arrangements included within the spirit and scope of the appended claims.

What is claimed is:

1. A portable care facility comprising:

at least one container defining a generally box-shaped configuration in a closed condition, said container being sized for transport and shipping and being constructed and arranged to be openable and expandable from said box-shaped configuration into a larger, operative configuration defining a space sufficient to conduct certain procedures therein, and tenting structure in said container and sized and configured to be supported over said space to define a ceiling over said space and to extend in at least one direction generally outwardly from said space to define a covered triage area.

2. The care facility according to claim 1, wherein said space is sized to define an operating area wherein medical procedures may be performed.

3. The care facility according to claim 2, wherein said operating area has a length of approximately 7 feet and a width of approximately eight feet, four inches.

4. The care facility according to claim 1, in combination with power generating equipment to provide power to said facility.

5. The care facility according to claim 1, wherein said container has a footprint generally 8'6" by 6'8" in its closed condition.

6. The care facility according to claim 5, wherein said container includes eye bolts so as to be capable of being supported and transported by means of a sling.

7. The care facility according to claim 1, wherein said container includes a chassis, frames defining cage structures, and vertical hinging side panel assemblies connecting said cage structures, said chassis including telescoping beams attached to said cage structures such that said cage structures may be moved from a collapsed, generally adjacent position to an expanded, operative position wherein said cage structures are in spaced relation, which causes said side panel assemblies to move from a collapsed position to an extended position, said panel assemblies define, with said expanded cage structures, said space.

8. The care facility according to claim 7, wherein each of said side panel assemblies includes a pair of panels and each said panel includes hinges on all vertical edges thereof.

9. The care facility according to claim 7, wherein opposing end panels of said boxed-shaped container adjacent said cage structures are movable downwardly to define entry and exit floor platforms.

10. The care facility according to claim 1, wherein certain panels of said container are movable to define overhead support panels, said support panels being constructed and arranged to support portions of said tenting structure.

11. The care facility according to claim 1, further including at least one supply container disposed within said container for housing medical equipment and/or supplies, said supply container being constructed and arranged to permit access to the contents of the container from opposing sides thereof.

12. The care facility according to claim 11, wherein a plurality of supply containers are provided and include one of an anesthesia machine, an oxygen generator, a blood refrigerator, a blood warmer, X-Ray equipment, suction equipment and an infusion pump.

13. The care facility according to claim 11, wherein a plurality of supply containers are provided and include one of thoracic sets, neuro-surgical sets, suture boxes, syringes and needles, I.V. fluids, general surgical orthopedic sets and abdominal surgical sets.

14. The care facility according to claim 7, wherein said cage units include vertical corner members including a retractable mast, each said mast being constructed and arranged to be moved from a retracted position within an associated vertical corner member to an upwardly extending position to provide support for said tenting structure.

15. The care facility according to claim 7, further including floor panels in said container, said floor panels being movable to defining flooring.

16. The care facility according to claim 1, further including at least one air handling unit to provide a positive pressure in said space.

17. The care facility according to claim 16, wherein said at least one air handling unit is movable from a storage position within said box-shaped container to an operative, position generally adjacent to said space.

18. A portable care facility comprising:

at least one container defining a generally box-shaped configuration in a closed condition, said container being sized for transport and shipping, said container having a central chassis, and opposing structural units movably coupled to said chassis so as to be moved from a collapsed storage position to an expanded, operative position, said structural units being coupled together via opposing side panel assemblies which are constructed and arranged such that as the structural units are moved to the operative position thereof, said side panel assemblies move from a collapsed position to an extended position defining a space sufficient to conduct certain procedures therein, and tenting structure in said container and sized and configured to be supported over said space to define a ceiling over said space and to extend in at least one direction generally outwardly from said space to define a covered triage area.

19. The care facility according to claim 18, wherein said structural units are coupled to said chassis by telescoping beams, and each said side panel assembly includes a pair of panels with each panel of said pair being coupled to a different one of said structural units and said pair of panels being connected together, wherein said panels of said pair have hinges on all vertical edges thereof.

* * * * *